United States Patent [19]

Dallman

[11] Patent Number: 4,681,044

[45] Date of Patent: Jul. 21, 1987

[54] ACCESS DOOR SYSTEM

[76] Inventor: Ernest R. Dallman, 9200 Fanchon Dr., Zionsville, Ind. 46077

[21] Appl. No.: 814,191

[22] Filed: Dec. 27, 1985

[51] Int. Cl.[4] ..... G07G 5/00

[52] U.S. Cl. ..... 109/24.1; 109/48; 52/65

[58] Field of Search ..... 109/24.1, 45, 48, 67, 109/68; 49/169, 171, 40, 49; 52/65, 67, 71

[56] References Cited

U.S. PATENT DOCUMENTS

| | | | |
|---|---|---|---|
| 1,777,901 | 10/1930 | Smith | 52/65 |
| 3,108,820 | 10/1963 | Rich | 52/65 |
| 3,955,322 | 5/1976 | Call, Jr. | 49/40 |
| 4,513,670 | 4/1985 | Berman | 109/24.1 |
| 4,577,562 | 3/1986 | Berman | 109/24.1 |
| 4,603,643 | 8/1986 | Couvrette | 109/24.1 |

*Primary Examiner*—Gary L. Smith
*Assistant Examiner*—Neill Wilson
*Attorney, Agent, or Firm*—Barnes & Thornburg

[57] ABSTRACT

An access door system for a building housing an automatic teller machine is disclosed. The system includes an outer door in the front wall of the building that opens to allow the door of the safe portion of the teller machine to open 180°. An arcuate shaped wall is attached to the opening edge of the outer door and extends along an arcuate path for 90°. A door is provided in the arcuate shaped wall that is lockable from inside the building to provide a secure work space for a technician servicing the teller machine.

16 Claims, 8 Drawing Figures

ACCESS DOOR SYSTEM

The present invention relates to an access system for a building. In particular, the present invention relates to an access system for a building in which the outside access door must remain open to accommodate the opening movement of the door of an enclosure located inside the building, and yet requires that the interior of the building be secured from unauthorized entry by individuals other than the technician inside. More particularly, the present invention relates to an access system for a building housing an automatic bank teller machine in which the safe door of the automatic teller is required to open outwardly to a position substantially perpendicular to the outer wall of the building containing the operator terminal portion of the teller machine, and where this outer wall of the building is also the preferred wall for access to the building.

Conventional automatic bank teller machines are increasingly being placed in isolated locations such as in parking lots, and the like. To protect the machines, buildings are normally constructed to contain the machine. Such a building normally contains an environmental control system including air conditioning and a heating unit. The building is also required to be secure from unauthorized entry because of the large amounts of money contained inside the automatic teller machine. It is also advantageous to have the building built to as small a dimension as possible, both to reduce construction costs, and to reduce the amount of space taken from the parking lot, and the like, for the building.

The buildings generally have at least one flat outer wall in which the operator panel for the automatic teller machine is located. Because this type of automatic teller machine is normally used by drive-up customers in automobiles, the outer wall containing the operator panel must be designed to allow the automobile to approach the operator panel as closely as possible. This is normally accomplished by having a drive-through lane designated, and having the outer wall of the building oriented parallel to this lane, and as close to the lane as possible.

Newer automatic teller machines of the type just described have a door to the safe portion of the machine that must open a full 180° to allow the safe portion to be reloaded with currency. The safe portion of these newer machines is located directly behind the operator panel of the machine.

To accommodate this opening movement of the safe door, and also to maintain the overall dimensions to a minimum, it has been found advantageous by manufacturers of the automatic teller machines to mount the safe door on one of the sides of the machine perpendicular to the operator panel, with the safe door hinged at the front of the machine, adjacent to the operator panel.

It will be understood that because the operator panel lies in the outer wall of the building, and the safe door is hinged at a point adjacent to the operator panel, if the outer wall adjacent the operator panel is solid, it would be possible to only open the safe door 90°. In order to accommodate the additional 90° of movement of the safe door, manufacturers of automatic teller machines have developed a rotating, quarter cylinder shaped insert that is placed in the outer wall of the building, adjacent to the operator panel. This insert generally consists of a light-weight, thin metal structure that includes a flat outer door-like portion, and an arcuate shaped portion attached to one edge of the door-like portion. The insert is hinged at a location adjacent to the hinge point of the safe door. The insert is rotated outwardly 90° away from the outer wall to create a space to accommodate the additional 90° of movement of the safe door, thus allowing the safe door to open a full 180°. The insert is usually driven open and closed by an electric motor, which is actuated from within the interior of the building housing the teller machine.

Access to the interior of the building is through a service door, usually located in the end of the building. Thus, to load or service the machine, a technician enters the service door in the end of the building. For security reasons, this service door must then be locked immediately to prevent any unauthorized persons from entering the building. The electric motor that drives the insert outwardly is then actuated to rotate the insert to its outward position. The technician then opens the safe door 180°, with the last 90° of rotation being outside the plane of the center wall of the building, within the insert.

One problem with the known inserts to accommodate the movement of the safe door is that because the technician cannot enter through the insert portion itself, an additional service door is required to enter the interior of the building. This increases the construction costs of the building, and decreases the overall strength of the building, by requiring two openings in the outside surface of the building, the opening to house the insert and the opening to house the service door.

Another problem with the known inserts to accommodate the movement of the safe door results from the need for a service door in the end of the building. Because of this service door, the building must be larger in size, in most cases longer, than would otherwise be necessary. Because it is necessary from a security standpoint for the technician to enter the building and lock the service door before the insert is rotated away from the safe to expose the safe door, the building must be long enough to allow the technician to enter the building and have enough space to stand to operate the insert. This necessarily dictates that the building be approximately three feet longer than would be required to house only the teller machine and the insert.

Another problem with the known inserts to accommodate the movement of the safe door is that because rotation of the insert is normally activated from within the interior of the building, it is impossible for the technician to observe whether or not an automobile has moved into a position to obstruct the outward movement of the insert. Thus, it is possible for the technician to open the insert while an automobile is sitting in the lane which could damage both the insert and the automobile.

One object of the present invention is to provide an insert for a building housing an automatic teller machine in which the service door and the insert are combined into one structure.

Another object of the present invention is to provide an insert for a building housing an automatic teller machine that does not require the building to be any longer than a length necessary to house the bank teller and the insert.

Another object of the present invention is to provide an insert for a building housing an automatic teller machine in which the insert is operable from outside the building to ensure that the insert does not come into contact with an automobile in the drive-through lane.

According to the present invention, an access system for a security building having an automatic teller machine having a safe portion in which the door must rotate a full 180° to open is disclosed. The system includes an outer door located adjacent to the operator panel of the teller machine. An arcuate shaped wall is attached to the opening edge of the outer door and extends along an arcuate path for substantially 90°. The outer door and the arcuate shaped wall cooperate when the outer door is open to provide means for defining a chamber outside the outer wall of the building to allow the safe door to open a full 180°. Means are provided for entering and exiting the chamber when the outer door is open and the chamber is outside the outer wall of the building.

In preferred embodiments of the present invention, the means for entering and exiting the chamber is a door in the arcuate shaped wall. One feature of the foregoing structure is that the door in the arcuate wall serves as the service door to the interior of the building. One advantage of this feature is that the building can be constructed with no additional openings in its structure. This allows the building to be constructed more economically, and further adds to the overall strength and integrity of the building. Another advantage of this feature is that the building can be smaller overall than the buildings having known inserts. The building only needs to be large enough to house the teller machine and the arcuate shaped wall when it is in the closed position. Again, this allows the building to be constructed more economically.

Also in preferred embodiments of the present invention, the outer door, and attached arcuate wall are opened from outside the building, adjacent to the drive-through lane. One advantage of the foregoing structure is that the technician must be in a position to observe the traffic flow through the drive-through lane before he can open the outer door and arcuate wall. This prevents the outer door from contacting an automobile that is in the drive-through lane.

Also in preferred embodiments of the present invention, the chamber formed by the outer door and arcuate wall includes a top wall and a bottom wall. One feature of the foregoing structure is that the chamber is sealed from the environment, even in the open position. One advantage of this feature is that the requirements of the environmental control unit located inside the building are not affected when the outer door is opened. This permits the environmental control unit to maintain a constant temperature and humidity within the interior of the building. Another advantage of this feature is that the building is easier to secure when the technician is inside the building.

Additional objects, features, and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
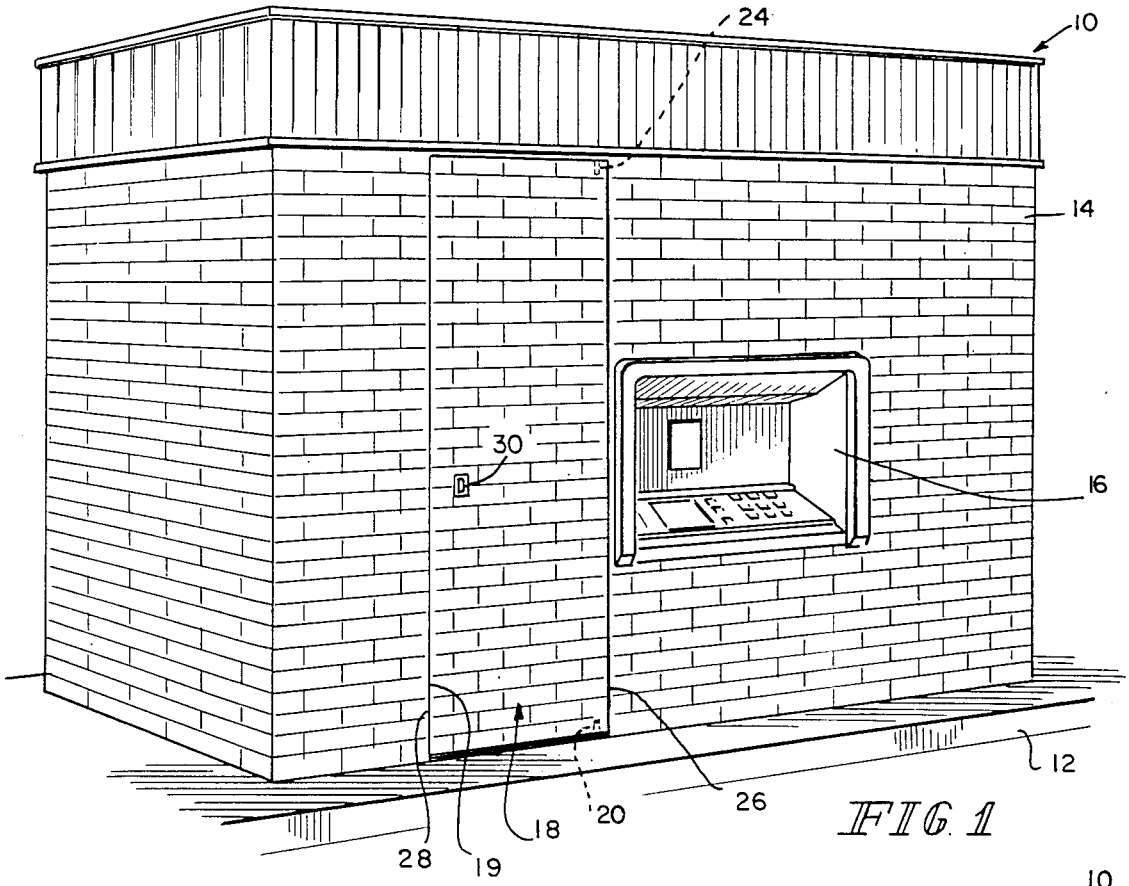
FIG. 1 is a perspective view of a free-standing building housing an automatic teller machine and showing the operator panel and the placement of the outer door.

Referring now to FIG. 1, a free-standing building 10 is shown. The building 10 is of conventional construction, with a brick exterior illustrated. The building 10 is constructed on a conventional slab of concrete or the like, having a curb 12. It will be understood that the curb 12 forms one border of a drive-through lane (not shown) for the building 10. The building 10 has a planar front wall 14 that extends horizontally parallel to the curb 12. An operator panel 16 of an automatic teller machine is mounted in the front wall 14 at a position that is accessible by a driver of an automobile in the drive-through lane.

An outer door 18 is mounted in an opening 19 of the front wall 14 at a position adjacent the edge of the operator panel 16. The outer door 18, at its hinged edge 26, is supported by, and pivots on, hinges 20 and 24. The opening edge 28 of the outer door 18 is secured in the closed position by a conventional lock assembly 30.

Figure 2:
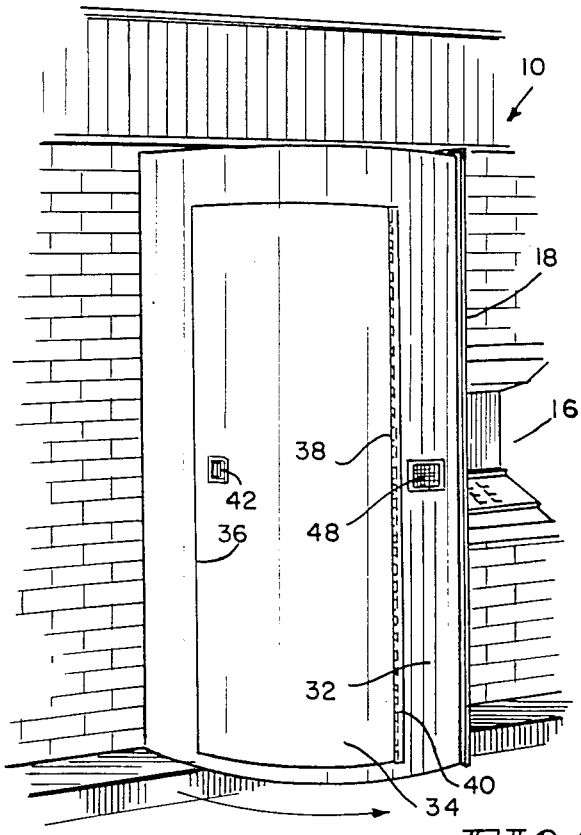
FIG. 2 is a partial perspective view showing the outer door in the open position along with the arcuate shaped wall.

Referring now to FIG. 2, the outer door 18 is shown in the open position. An arcuate shaped wall 32 is attached to the opening edge 28 of the outer door 18. The arcuate shaped wall 32 has substantially the same vertical height as the outer door 18, and extends along an arcuate path for substantially 90°.

A door 34 is mounted in the arcuate shaped wall 32 and has an opening edge 36 and a hinged edge 38. The door 34 has a vertical height less than the vertical height of the arcuate shaped wall 32, with the exact height chosen to allow easy entry through the door 34. A continuous piano type hinge 40 is attached to the hinged edge 38 of the door 34 and further attached to the arcuate shaped wall 32. A conventional lock assembly 42 is mounted near the opening edge 36 of the door 34 to secure the door 34 in the closed position.

Figure 3:
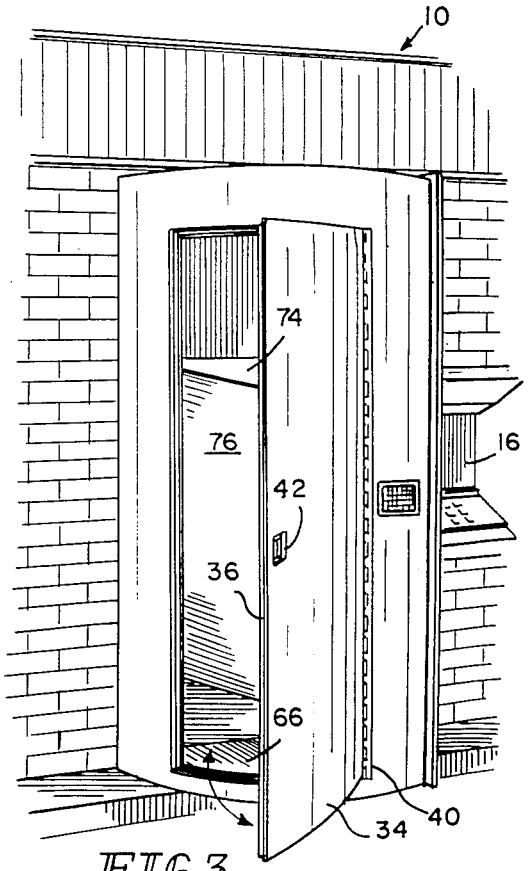
FIG. 3 is a partial perspective view showing the outer door in the open positin and the door in the arcuate shaped wall in the open position to allow entry to the chamber and to the interior of the building.

A light 48 is mounted in the arcuate shaped wall 32 at the appropriate height to be in the line of sight of a driver in an automobile proceeding through the drive-through lane. The light 48 is activated in a conventional manner when the outer door 18 is opened to alert drivers that the automatic teller machine is not in service. The door 34 is opened by unlocking the lock assembly 42 and manually pulling the door to the open position, as shown in FIG. 3.

Figure 4:
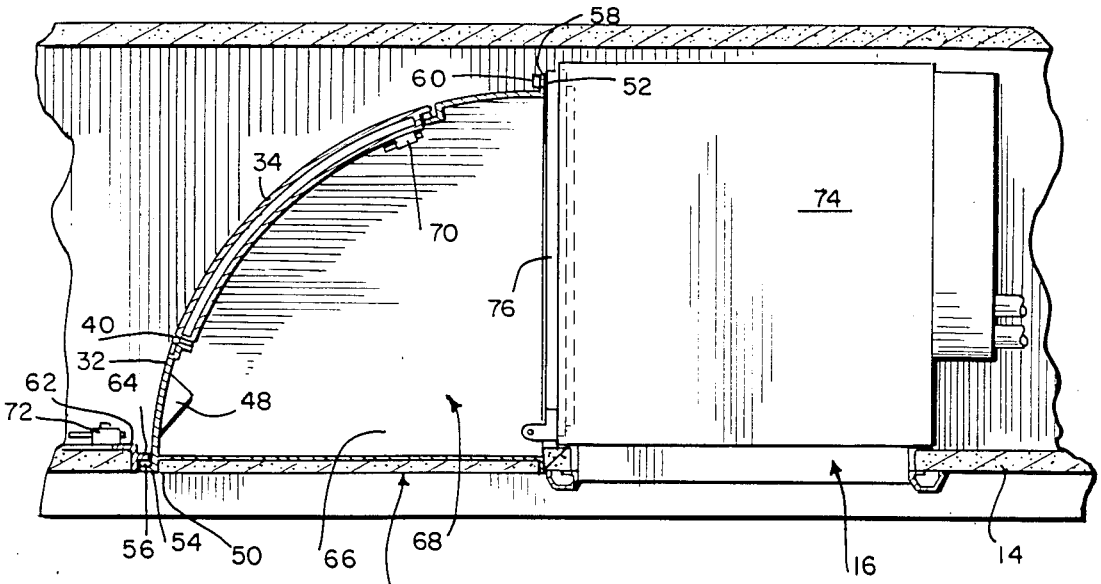
FIG. 4 is a top plan view of the building and the enclosed teller machine with the outer door closed.

Referring now to FIG. 4, the arcuate shaped wall 32 includes an outer edge 50 and an inner edge 52. It will be understood that the outer edge 50 is attached to the opening edge 28 of the outer door 18. The outer edge 50 has an upturned end forming an inwardly facing flange 54 that extends substantially the full vertical height of the arcuate shaped wall 32. A conventional rubber seal 56 having a magnetic core is attached to the flange 54.

The inner edge 52 also has an upturned end forming an outwardly facing flange 58 that extends substantially the full vertical height of the arcuate shaped wall 32. A conventional rubber seal 60 having a magnetic core is attached to the flange 58. It will be understood that the seals 56, 60 are identical.

Figure 5:
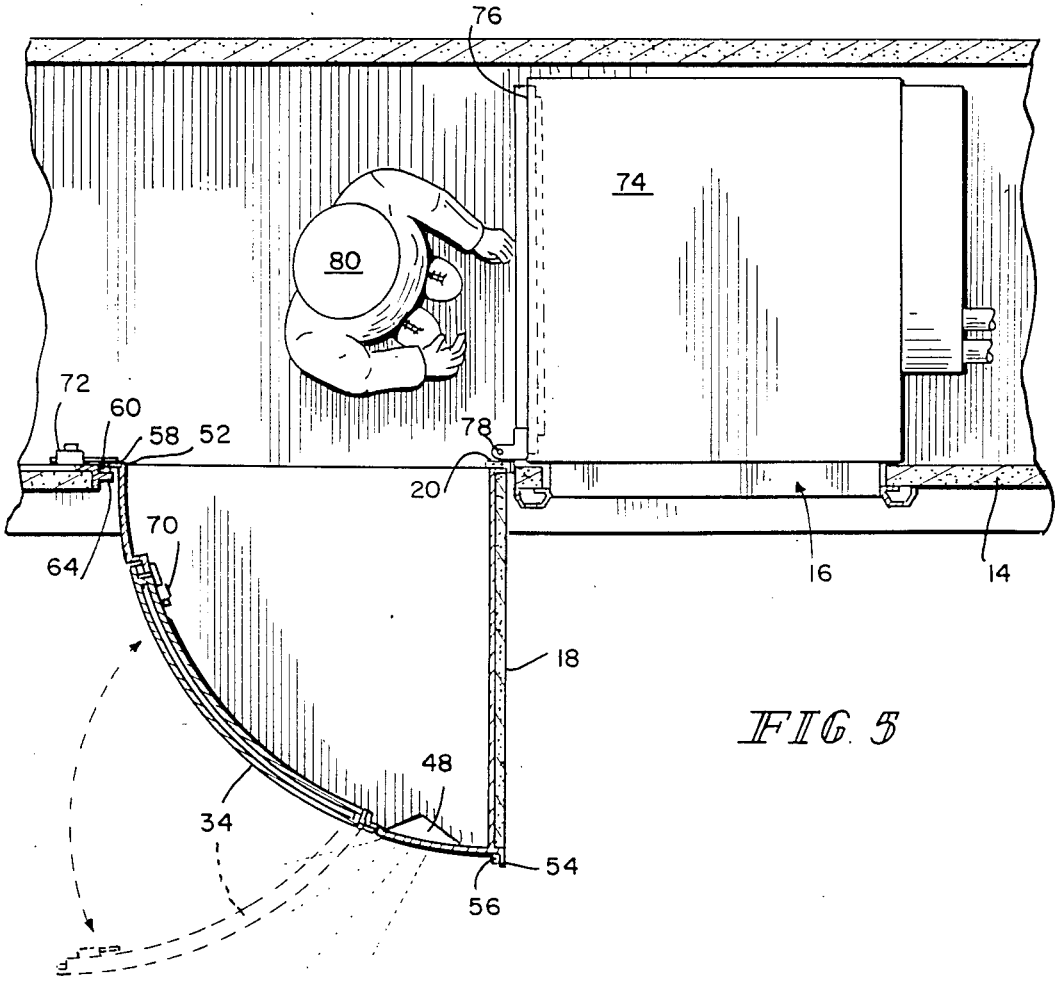
FIG. 5 is a top plan view of the building showing the outer door open and the technician inside the building with the door in the arcuate shaped wall reclosed from its open position shown in dotted lines.
Figure 6:
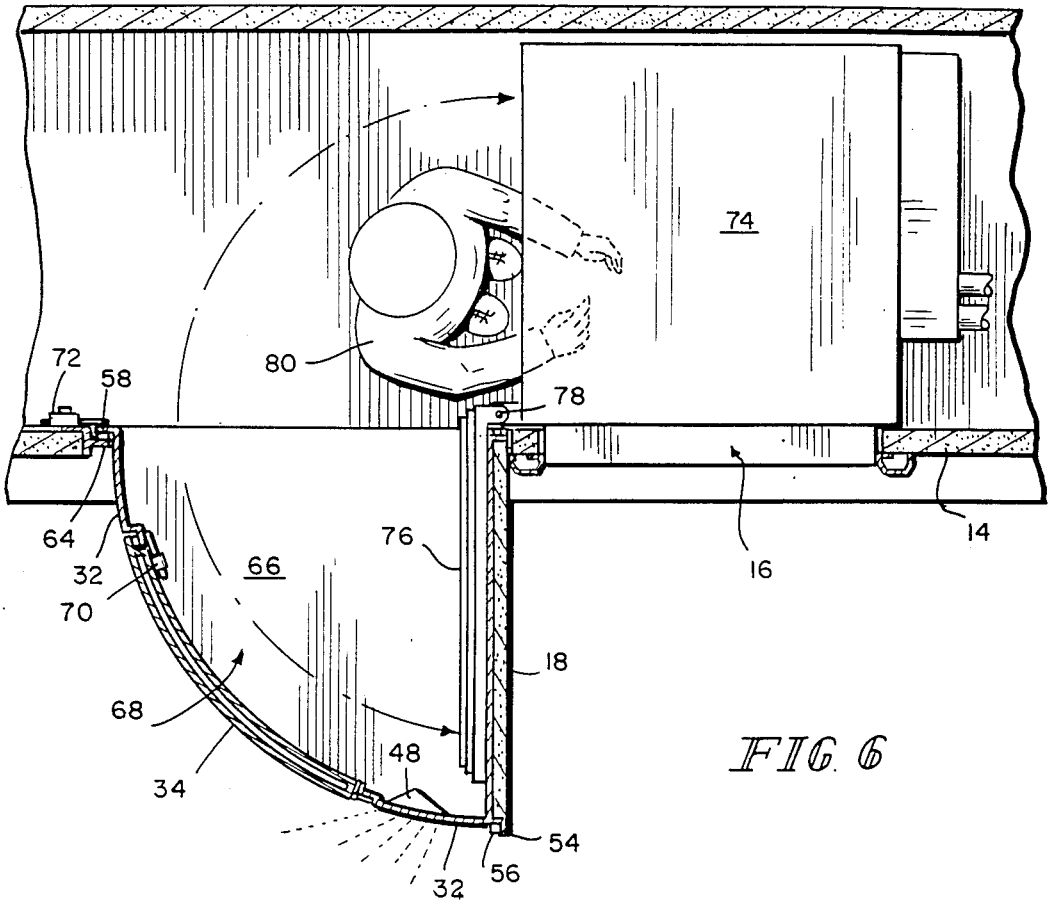
FIG. 6 is a top plan view of the building showing the outer door open and the safe of the teller machine open at 180° to its full open position.

A door jam 62 is attached to the vertical edge of the opening 19 complementary with the opening edge 28 of the outer door 18. The door jam 62 extends substantially the full vertical height of the arcuate shaped wall 32. The door jam 62 includes a ridge 64 that functions as a sealing surface to alternatively mate with the seal 56 when the outer door 18 and arcuate shaped wall 32 are in the closed position, as shown in FIG. 5, and to mate with the seal 60 when the outer door 18 and the arcuate shaped wall 32 are in the open position, as shown in FIG. 6.

A sectoral shaped bottom wall 66 is attached to the bottom edge of the outer door 18 and the bottom edge of the arcuate shaped wall 32. The bottom wall 66 serves as a floor for a chamber 68 defined by the outer door 18 and the arcuate shaped wall 32. A sectoral shaped top wall identical to the bottom wall 66 serves as a ceiling for the chamber 68 and is not shown.

A conventional slide lock 70 is mounted on the inside of the opening edge 36 of the door 34 to allow the door 34 to be locked in the closed position from inside the chamber 68. A conventional slide lock 72, similar to lock 70, is mounted on the inside of the door jam 62 to allow the arcuate shaped wall 32 and the outer door 18 to be secured in the open position from inside the building 10, as shown in FIG. 5.

Figure 7:
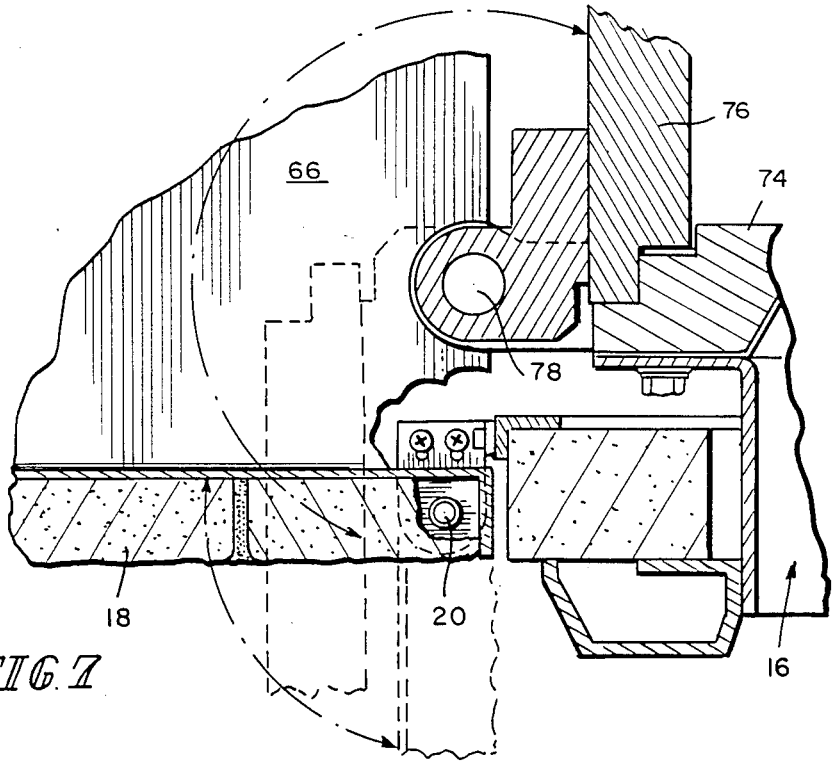
FIG. 7 is an enlarged top plan view of one of the hinge arrangements that supports the outer door and attached arcuate shaped wall.

The automatic teller machine includes a safe 74 having a safe door 76. The safe door 76 pivots on a hinge 78 mounted near the bottom of the safe 74, as best shown in FIG. 7, and an identical top hinge that is not shown. The hinge 78 extends away from the safe 74 a distance sufficient to allow the safe door 76 to clear the hinge 20 when the safe door 76 is open 180°, as shown in dotted line in FIG. 7.

The hinge 20 is a conventional offset hinge mounted on the floor of the building 10 and capable of supporting the weight of the outer door 18 and the arcuate shaped wall 32, as well as the weight of a technician 80. It will be understood that the hinge 24 is identical to the hinge 20, however it is mounted above the outer door 18.

In operation, initially the outer door 18 will be in the closed position, as shown in FIG. 4. The technician 80 unlocks the lock assembly 30 in the outer door 18 and manually pulls the outer door 18 and the attached arcuate shaped wall 32 to the open position. Opening the outer door 18 activates the light 48 to warn potential customers that the automatic teller machine is closed. The technician 80 then unlocks the lock assembly 42 on the door 34 and enters the chamber 68. The technician then locks the slide lock 70 on the door 34 to secure the door 34. The technician 80 also locks the slide lock 72 to secure the arcuate shaped wall 32 and the outer door 18 in the open position. The technician is now inside the building and is protected from unauthorized access by any other person.

The seal 60 seals against the ridge 64 of the door jam 62, as shown in FIG. 5, to seal the interior of the building 10 from the environment.

Figure 8:
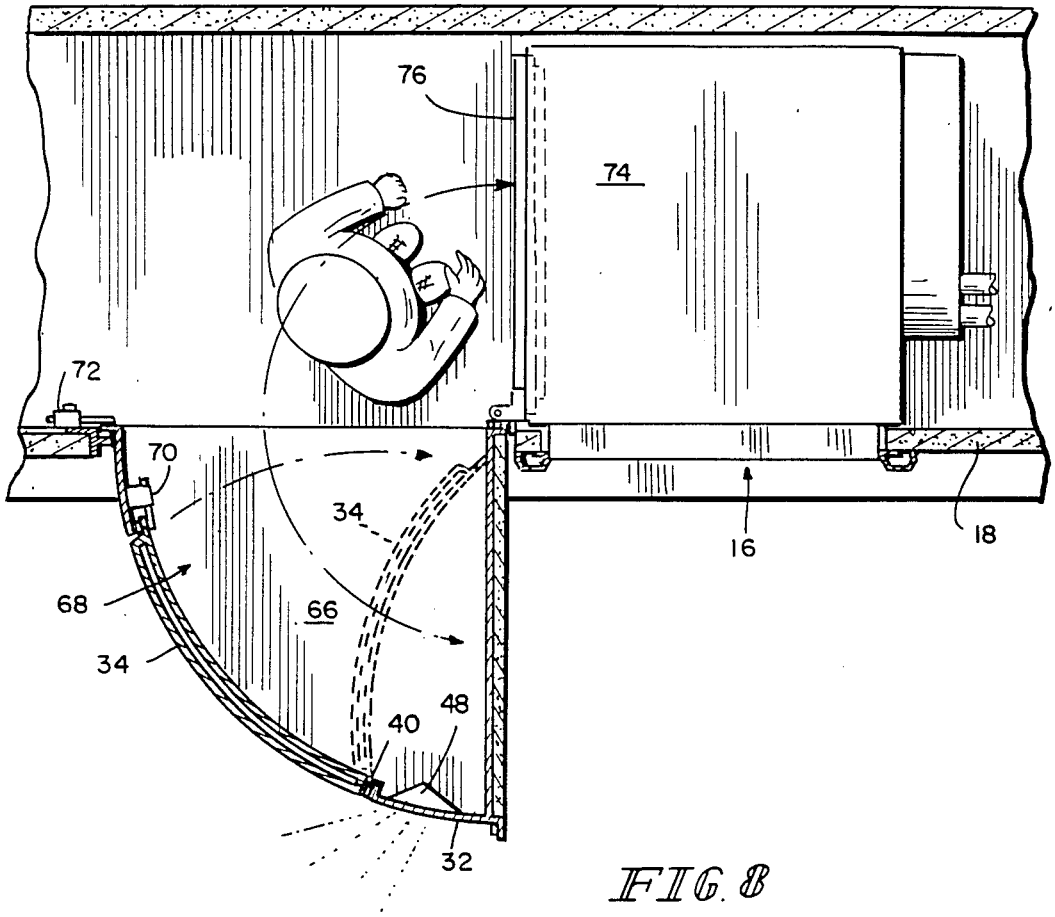
FIG. 8 is a top plan view of the building showing a modification of the present invention in which the door in the arcuate shaped wall is hinged to open inwardly.

The technician 80 then opens the safe door 76 to its full open position, as shown in FIG. 6. The technician now has access to the inside of the safe 74 to either load money into the safe, or to perform repairs. After the necessary operations, the technician 80 closes the safe door 76, as shown in FIG. 8. The technician 80 then unlocks the slide lock 72, and unlocks the slide lock 70 and exits through the door 34 in the arcuate shaped wall 32. The technician then closes the outer door 18 and locks the lock assembly 30 to secure the outer door.

FIG. 8 shows a modification of the preferred embodiment in which the door 34 is provided to open inwardly into the chamber 68. This modification adds additional security because the piano hinge 40 is located inside the chamber 68, thus making tampering with the piano hinge 40 more difficult.

Although the invention has been described in detail with reference to a preferred embodiment and specific examples, variations and modifications exist within the scope and spirit of the invention as described and defined in the following claims.

What is claimed is:

1. An access system for access to an automatic teller machine enclosure defining an interior space and having a planar front surface defining a plane and containing an automatic teller machine that includes a panel that must rotate outwardly through said plane to a position substantially perpendicular to said plane, the system comprising:

a first door pivotable from a closed position to an open position having a hinged edge and an opening edge and having a first vertical height that lies in said plane when said first door is in the closed position;

an arcuate shaped wall having a first edge attached to said opening edge of said first door and having a vertical height substantially equal to said first vertical height; said wall extending along an arcuate path for substantially 90° and terminating at a second edge;

said first door and said wall cooperating when said first door is opened substantially 90° to provide a chamber substantially outside said enclosure and adjacent said plane defined by said front surface that is in direct communication with said interior space to permit said panel to rotate outwardly through said plane into said chamber to a position substantially perpendicular to said plane without interference;

a second door formed in said arcuate shaped wall and movable from a closed position to an open position to permit entry into said chamber when said chamber is substantially outside said booth;

a bottom wall attached to said exterior door and to said arcuate wall to provide a floor for said chamber capable of supporting an operator; and means for alternately securing said first door in the closed position and in the open position.

2. The access system of claim 1, further comprising a top wall attached to said first door and to said arcuate shaped wall to provide a cover for said chamber.

3. The access system of claim 1, wherein said second door is arcuate shaped and coincides with the arcuate shaped wall when in the closed position.

4. The access system of claim 3, wherein said second door opens outwardly with respect to said chamber.

5. The access system of claim 3, wherein said second door rotates inwardly with respect to said chamber.

6. The access system of claim 1, wherein said first door, said arcuate wall, and said second door are formed from a material having sufficient strength to provide security for said booth when said first door is in either the open or closed position.

7. The access system of claim 1, further comprising a light mounted in said arcuate wall that is activated when said first door is in the open position.

8. The access system of claim 1, further comprising means for selectively securing said second door in the closed position from within said chamber.

9. An access device for access to a security booth defining an interior space and having a planar front surface defining a plane and containing an automatic teller machine that includes a panel that must rotate outwardly through said plane to a position substantially perpendicular to said plane, the device comprising:

a rotating enclosure defining a chamber that rotates about an axis between a closed position and an open position, the axis lying substantially in said plane, the rotating enclosure including a planar wall having a first vertical height and a first edge and a second edge, the first edge being substantially coincident with said axis of rotation, and an arcuate wall having a vertical height substantially equal to said first vertical height attached to said second edge of said planar wall and extending along an arcuate path for substantially 90°;

said planar wall of said enclosure lying in said plane when said enclosure is in the closed position and being substantially perpendicular to said plane when said enclosure is in the open position to place said chamber in communication with said interior space to permit said panel on said automatic teller machine to rotate outwardly through said plane to a position substantially perpendicular to said plane without interference;

a door formed in said arcuate wall and movable from a closed position to an open position to permit entry into said enclosure when said enclosure is in the open position;

a lower wall attached to said planar wall and said arcuate wall to provide a floor for said enclosure; and means for alternately securing said rotating enclosure in the closed position and in the open position.

10. The access device of claim 9, further comprising an upper wall attached to said planar wall and said arcuate wall to provide a cover for said enclosure.

11. The access device of claim 9, wherein said door is arcuate shaped and includes an outer surface that is substantially coincident with said arcuate wall when said door is closed.

12. An access device for access to the interior of a security booth designed to be limited to one entrance and having a planar front surface defining a plane and containing an apparatus that includes a panel that must rotate outwardly through said plane to a position substantially perpendicular to said plane, the device comprising:

a planar blocking wall having a hinged edge and an opening edge and a first vertical height and including means for rotating about an axis parallel to said plane from a closed position where said blocking wall lies in said plane and away from said plane to an open position where said blocking wall is substantially perpendicular to said plane;

an arcuate access wall attached to the opening edge of said blocking wall and having a vertical height substantially equal to said first vertical height and extending along an arcuate path for substantially 90° and including a door, said blocking wall and said access wall cooperating to define an access space;

wherein rotation of said blocking wall to the open position places said access space in communication with said interior of said booth and allows access from outside said booth to said door on said arcuate wall to allow a technician to enter said access space and said interior and further allows said panel to rotate to a position substantially perpendicular to said plane without interference, and rotation of said blocking wall to the closed position which seals said entrance and denies access to said door from outside said booth to secure said booth.

13. The access device of claim 12, further comprising a top wall attached to said blocking wall and said access wall to provide a cover for said access space.

14. The access device of claim 12, further comprising a bottom wall attached to said blocking wall and said access wall to provide a floor for said access space.

15. The access device of claim 12, further comprising means to lock said blocking wall alternately in the closed position and in the open position.

16. In an automatic teller machine enclosure housing an automatic teller machine having a safe door, the enclosure having a rotating, quarter cylinder-shaped insert mounted in an outer wall having means for rotating from a closed position to an open position to define a chamber in communication with said teller machine enclosure to permit the teller machine safe door to open outside said outer wall to a position approximately perpendicular to said outer wall, the insert including a generally flat, first door portion and an arcuate-shaped portion attached to one edge of the first door portion, the improvement comprising, an access door formed in said arcuate-shaped portion to permit access to said chamber and to said teller machine enclosure when said rotating insert is in the open position, and means for alternately securing said insert in the closed position and in the open position, said first portion sealing said enclosure in the closed position.

* * * * *